United States Patent [19]

Smith

[11] 4,425,227

[45] Jan. 10, 1984

[54] AMBIENT FROTH FLOTATION PROCESS FOR THE RECOVERY OF BITUMEN FROM TAR SAND

[75] Inventor: Scott L. Smith, Salt Lake City, Utah

[73] Assignee: GNC Energy Corporation, Dallas, Tex.

[21] Appl. No.: 308,491

[22] Filed: Oct. 5, 1981

[51] Int. Cl.[3] ..... B03B 1/00

[52] U.S. Cl. ..... 209/5; 209/10; 209/166; 208/11 LE

[58] Field of Search ..... 209/3, 5, 9, 10, 166, 209/167; 208/11 E

[56] References Cited

U.S. PATENT DOCUMENTS

| | | | |
|---|---|---|---|
| 1,425,186 | 8/1922 | Ellis | 209/166 |
| 1,615,121 | 1/1927 | Fyleman | 209/166 |
| 3,331,765 | 7/1967 | Canevari et al. | 208/11 E |
| 3,399,765 | 9/1968 | Puddington et al. | 209/5 |
| 3,401,110 | 9/1968 | Floyd et al. | 209/5 |
| 3,422,000 | 1/1969 | Bichard | 209/166 |
| 3,556,982 | 1/1971 | Kaminsky et al. . | |
| 3,573,196 | 3/1971 | Cymbalisty . | |
| 3,623,971 | 11/1971 | Bowman . | |
| 3,726,786 | 4/1973 | Given . | |
| 3,808,120 | 4/1974 | Smith . | |
| 3,816,305 | 6/1974 | Schutte . | |
| 3,891,550 | 6/1975 | Gray et al. . | |
| 3,935,076 | 1/1976 | Cymbalisty . | |
| 3,951,778 | 4/1976 | Willard . | |
| 4,029,568 | 6/1977 | Pittman et al. . | |

FOREIGN PATENT DOCUMENTS

| | | | |
|---|---|---|---|
| 586229 | 11/1959 | Canada | 208/11 E |
| 171918 | 12/1921 | United Kingdom | 208/11 E |
| 2044796A | 10/1980 | United Kingdom | 208/11 E |

*Primary Examiner*—Bernard Nozick

*Attorney, Agent, or Firm*—Richards, Harris & Medlock

[57] ABSTRACT

A method for upgrading the bitumen content of tar sands, wherein a raw tar sand slurry admixture of tar sands, water, collectors, and dispersing/wetting agents is milled; conditioned and then separated by a series of froth flotations at ambient temperatures from about 2° C. to about 25° C. to recover a concentrated bitumen tar sand product which may be processed by conventional means to recover oil from the bitumen. Enhanced recovery of bitumen may be accomplished by moderate heating in one or more of the flotation zones to about 50° C. The method permits recovery and recycle of various components used in processing of the tar sand.

6 Claims, 1 Drawing Figure

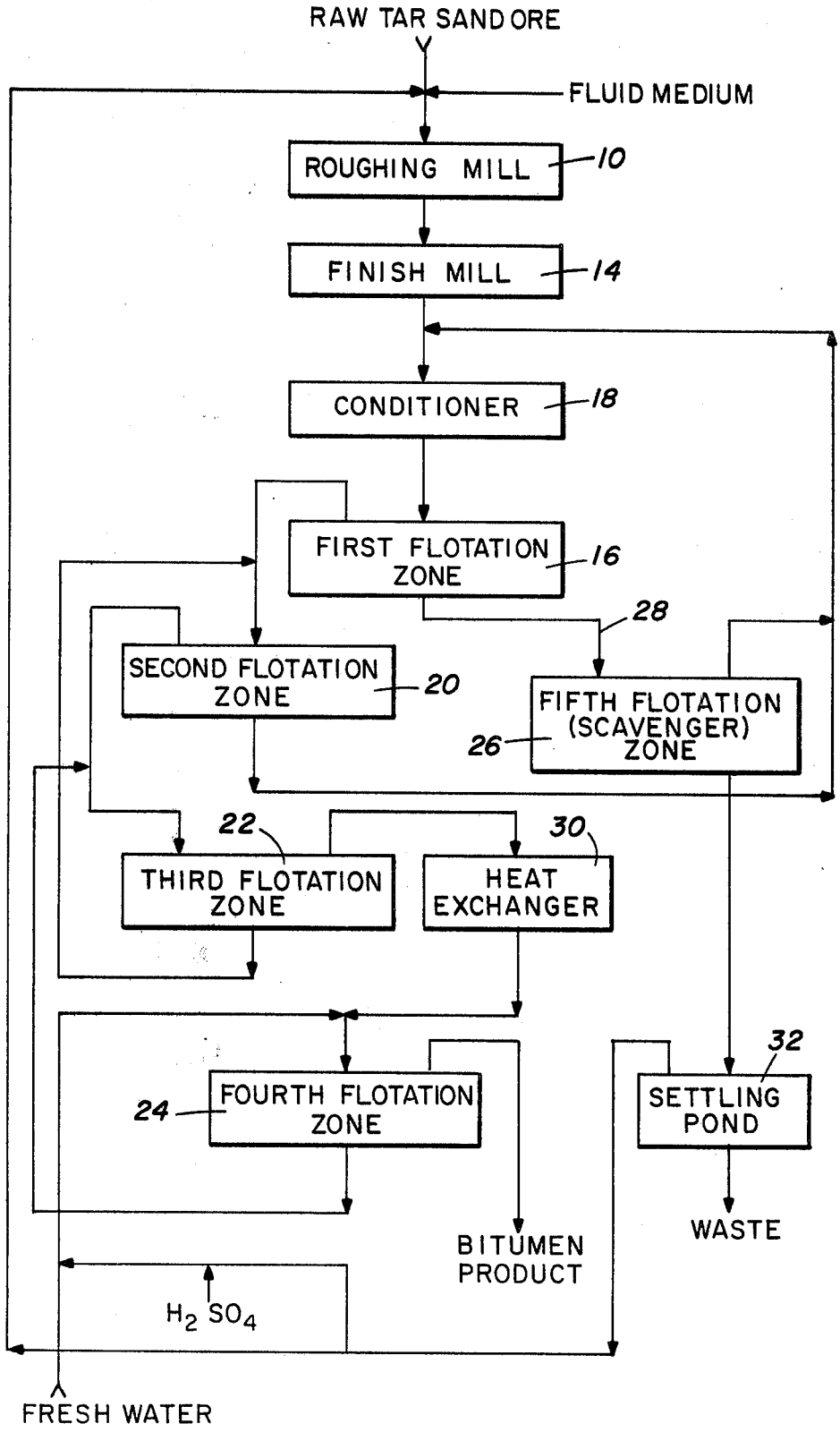
RAW TAR SAND ORE
FLUID MEDIUM
ROUGHING MILL
10
FINISH MILL
14
CONDITIONER
18
FIRST FLOTATION ZONE
16
28
SECOND FLOTATION ZONE
20
FIFTH FLOTATION (SCAVENGER) ZONE
26
22
30
THIRD FLOTATION ZONE
HEAT EXCHANGER
32
24
FOURTH FLOTATION ZONE
SETTLING POND
WASTE
BITUMEN PRODUCT
$H_2SO_4$
FRESH WATER

AMBIENT FROTH FLOTATION PROCESS FOR THE RECOVERY OF BITUMEN FROM TAR SAND

BACKGROUND OF THE INVENTION

In one aspect, the present invention relates to a method of conditioning raw tar sand to render it suitable for the separation of bitumen from the tar sand by froth flotation. In another aspect, the present invention relates to a method for processing raw tar sand to produce a bitumen enriched tar sand product more suitable for subsequent extraction of bitumen. In yet another aspect, the present invention relates to upgrading the bitumen content of tar sands through separation by froth flotation of a milled tar sand slurry to produce a concentrated tar sand product. In still a further aspect, the invention relates to a method whereby components of the tar sand slurry may be recovered and recycled for reuse. In yet another aspect, the present invention relates to the preparation of a fluid medium suitable for use in the separation of bitumen from tar sands by froth flotation.

Tar sands (also known as oil sands and bituminous sands) are sands which are impregnated with dense, viscous petroleum. Technically, the material should perhaps be called bituminous sand rather than tar sand since the hydrocarbon is a bitumen (i.e., a carbon disulfide-soluble oil). Herein these sands will be referred to as "tar sands". Deposits of tar sands are found in many countries, for example, Canada, the United States, and Venezuela. Tar sand deposits found in the Province of Alberta, Canada are being exploited commercially. In the United States, tar sand deposits are found in the Uinta basin of Utah and Colorado. These tar sands deposits contain billions of tons of tar sands which would be very valuable provided an economical method of separating the bitumen from the sand was available.

At present, the Canadian tar sands have been the subject of most of the research and development efforts conducted to date. The Canadian tar sands deposits are characterized by a sandstone grain covered by a layer of water which is covered with bitumen. Two methods of recovery of bitumen from these Canadian deposits are known as "the cold water method" and "the hot water method".

The "cold water method" does not involve heating of the tar sand other than whatever heating may occur during normal factory operations. The process involves mixing the tar sand with water at ambient temperature, soda ash and an organic solvent. The mixture is then permitted to settle at ambient temperature and a mixture of solvent and bitumen dissolved in the organic solvent rises to the top of the settling zone, much in the manner of cream rising in milk, and is recovered. The cold water method has not achieved commercial acceptance in Canada due to the physical nature of the Canadian tar sands.

The best known and most widely used method in the recovery of bitumen from Canadian tar sands is often referred to as the "hot water method". In general, the hot water process involves heating the tar sand with steam or hot water, milling the tar sand with a small portion of water at about 175° F., transferring the tar sand into a turbulent stream of circulating water and carrying it through a separation cell maintained at an elevated temperature of about 180° F. In the separation cell, entrained air causes the oil to rise to the top and form a froth rich in bitumen which is then drawn off.

The sand settles to the bottom and may be removed. It is believed that separation of bitumen from Canadian tar sands is effected by disruption of the sheath of water surrounding the sandstone grain thereby also disrupting the bitumen covering of the water sheath, allowing the bitumen to rise to the top of the separation cell. The basic hot water system may be enhanced as described in U.S. Pat. No. 3,573,196 issued to Cymbalisty on Mar. 30, 1971, by adding a light hydrocarbon solvent to the slurry which is at a temperature below the boiling point of the solvent and subsequently heating the slurry to the boiling point of the hydrocarbon solvent, which volatilizes the solvent and assists in the separation of the bitumen.

These methods have been used to process the raw tar sand as mined. Raw tar sand ores typically contain from about 6% to about 12% bitumen by weight. Thus, treatment of the raw ore by both methods requires enormous quantities of water in relation to the bitumen recovered because of the low bitumen content in the raw tar sands. The cold water method described above as well as using large quantities of water requires large settling ponds. The hot water recovery method permits an energy recovery in the range of 50 to 60% of the bitumen processed. In other words, approximately one-half of the energy value of the recovered bitumen by the hot water method is consumed in its production.

The present invention provides a method whereby the raw tar sand ore may be concentrated, thereby increasing the bitumen content of the tar sand processed for bitumen recovery. By utilizing cold (ambient) water in the concentration of the tar sands in accordance with the method of the present invention, the amount of energy necessary to extract the bitumen from the concentrated tar sand is less per unit of bitumen recovery. Another advantage of the present invention is that the froth flotation apparatus utilized is less expensive to purchase, operate and maintain, and consumes less energy than the specially designed attritioning devices utilized in the hot water method. Potentially, an energy recovery rate of 90% is possible. In still another aspect, the invention allows the utilization of standard equipment readily available in the market. The method allows for recycle of the water agents thereby reducing water consumption, which is an important factor in recovery of bitumen from tar sands in the Western United States.

SUMMARY OF THE INVENTION

According to the present invention, it has been discovered that the bitumen content of raw tar sands may be concentrated by admixing a raw tar sand slurry of tar sand and an appropriate aqueous medium. The method may be practiced through the application of standard equipment used in the recovery of ores. The aqueous medium may contain dispersing/wetting agents and collectors. The slurry is then subjected to froth flotation to separate coarse sand from bitumen and sand bearing bitumen. As used herein, "froth flotation" is used to indicate a process similar to that used in processing ores to separate valuable minerals from gangue, by introducing a gas into a pulp of finely divided ore in a fluid medium containing a collector plus frothing or foaming agents. In the preferred embodiment of the subject invention, it has been discovered that by admixing tar sand with water, dispersing/wetting agents such as soda ash and trisodium phosphate, and a collector such as diesel fuel that upon froth flotation approximately 90 to 95% of the bitumen in the feed may be concentrated onto one-third of the sand; thus, allowing two-thirds of the sand contained in the feed which is now substantially free of bitumen to be removed as waste with little energy expenditure.

According to another aspect of the present invention, it has been found that milling of the tar sand slurry to reduce the particle size of the sand grains is preferable and aids in the separation of the bitumen. The desired particle size varies according to the physical nature of the tar sand processed, but normally an average particle size below 100 microns is desired. Recovery is further enhanced by conditioning the milled slurry prior to froth flotation. The purpose of conditioning is to thoroughly admix the fluid medium with the tar sand to achieve the maximum benefit of the dispering/wetting agents and collectors. Conditioning allows the intimate mixture of these components without further reduction of the particle size of the sand grains.

According to still another aspect of the present invention, it has been found that the addition of hydrated lime and flocculant to the tailings enhances settling and filtration of the tailings, thereby permitting water to be available for recycle. Addition of the hydrated lime and flocculants precipitates out calcium carbonate and calcium phosphates and generates caustic sodium hydroxide which is recycled with the water. Neutralization of the generated sodium hydroxide may not be necessary because it acts as a dispersing/wetting agent.

BRIEF DESCRIPTION OF THE DRAWINGS

A more complete understanding of the objects of the present invention may be had by reference to the accompanying FIGURE, which is a schematic representation of the preferred embodiment of the present invention, together with the Detailed Description.

DETAILED DESCRIPTION

The hot water method has proved useful in the recovery of Canadian tar sands. However, the hot water process is not economical for the recovery of bitumen from tar sand deposits found in the Western United States. These tar sand deposits are characterized by a sandstone grain which is covered directly with the layer of bitumen. In order to remove the bitumen from the sand grain, it is necessary to break the bond between the bitumen and sand grain. One feature of the present invention is the breaking of the bond between the bitumen and sandstone grain, replacing the bitumen with another fluid such as water, thereby allowing the separation of the bitumen from the sand.

FIG. 1 is a schematic representation of the preferred embodiment of the present invention. The raw tar sand extracted from the earth by known methods such as strip mining is delivered and admixed with a fluid medium to form a slurry. The slurry is fed into a roughing mill 10 such as a semi-autogenous cylindrical mill or SAG mill to form a roughly milled slurry which exits mill 10 via line 12 and passes to a finish mill 14.

A slurry suitable for processing by the method of the present invention is prepared by mixing the raw tar sand with a fluid medium. The fluid medium contains wetting/dispersing agent(s), collector(s) or combinations thereof. The fluid medium may be an aqueous medium which is preferable due to its low cost. The aqueous medium contains water plus one or more of the following components: dispersing/wetting agents, and collector(s).

The dispersing/wetting agents and diluents all serve to assist in the breaking of the bond between the bitumen and the sand grain upon which it is deposited, thereby permitting water to selectively wet the sand grain displacing the bitumen. Water forms a stronger bond with the sand grains than the bitumen. The milling process assists in the initial breaking of the bitumen-sand grain bond thus allowing water to wet the sand. Bitumen is prevented from reattaching itself to the sand grains by the layer of water.

Any suitable dispersing/wetting agent may be used in the practice of the present invention. In general, suitable dispersing/wetting agents include sodium carbonate, soda ash, and phosphate compounds, for example, tri-sodium phosphate, sodium hexametaphosphate, sodium tri-polyphosphate, and sodium phosphate. Other dispersing/wetting agents such as sodium metasilicate, or sodium silicate may be used, however, they are generally less effective than sodium phosphate compounds. The preferable dispersing/wetting agent is a mixture of tri-sodium phosphate and soda ash.

Soda ash may be supplied in the form of naturally occurring trona mineral. Under the method of the present invention, sodium hydroxide is generated when hydrated lime is added to the tailings produced by the method of the present invention. The lime precipitates out calcium carbonates and calcium phosphates thereby generating sodium hydroxide. The sodium hydroxide generated remains in the recycled water which is introduced upstream of the first flotation zone 16 and preferably before the roughing mill 10 to assure adequate mixing and to allow sufficient time to achieve the maximum wetting effect upon the sand grains and also to prevent sticking of the bitumen to the grinding mills. Those skilled in the art will appreciate that the recycle water and sodium hydroxide may be recycled to other steps also. Soda ash, sodium carbonate or other dispersing/wetting agents may be added to the fluid medium during the initial milling steps, conditioning or later flotation zones. Preferably these dispersing/wetting agents are added during the milling steps.

The collector may be any light hydrocarbon oil such as diesel fuel, kerosine, or No. 2 burner oil. The collector serves as a collecting sight for the bitumen and aids in froth formation. The collector is added preferably in the range of 0.13% to about 1.4% by weight based on weight of raw tar sand feed.

A basic fluid medium of water and a dispersing/wetting agent such as sodium carbonate or soda ash may be added in the milling step. Other components of the fluid medium may be mixed with either the basic medium initially in the grinding step or in one or more of the later steps or a combination thereof. Although the other components of the fluid medium may be added at virtually any stage, it is preferable that they be added prior to the milling step in order that their optimum effect be achieved.

Sufficient water must be incorporated with the raw tar sand to form a slurry which permits the raw tar sand to be dispersed throughout the fluid medium such that froth flotation techniques may be employed. Satisfactory froth flotation separation may be obtained when water is mixed with the tar sand in the range of about 275 parts to about 325 parts water based on 100 parts of raw tar sand by weight, and preferably the slurry is a 1:3 ratio of raw tar sand to water by weight. In the later flotation zones, higher percentages of water may be utilized.

The raw tar sand slurry is prepared by mixing raw ore with the fluid medium and feeding the slurry into the roughing mill 10. In roughing mill 10, the coarse rock is broken into fragments suitable for introduction into the finish mill 14, preferably in the range of about 0.25 inches to about 0.5 inches. Preferably the slurry fed into roughing mill 10 is about 75% solids by weight in order to minimize the size of the equipment.

The roughly milled raw tar sand slurry is then finish milled in finish mill 10 to a particle size conducive to separation of the bitumen. The desired particle size produced by the finish milling is dependent on the physical character of the tar sand being processed. In most cases, it is believed that this will be less than 100 microns. Additional aqueous medium may be added to the roughly milled slurry to decrease the solid ratio to a range which will be suitable for froth flotation. Normally a slurry with less than about 55% solids is desired. Finish mill 14 may be any suitable mill for reducing the particle size of an ore such as a ball mill or rod mill.

The milling steps serve to reduce the particle size of the raw tar sand and, it is also believed, to fracture the bitumen coating of the tar sand such that the mixture of water, dispersing/wetting agents may replace the bitumen and thus facilitate its later recovery. Milling also aids in the initial collection of bitumen by the collector. The finish milled slurry is flowed through conditioner 18. The purpose of conditioner 18 is to assure that the slurry is intimately mixed and that the sand wetting process has been performed thoroughly. Conditioner 18 may be a tube mill, or merely a long pipeline or any similar device which permits thorough mixing of the finish milled slurry. Preferably, conditioning does not substantially reduce the particle size of the sand grains exiting the finish mill 14. While separation may be accomplished if the conditioning step is omitted, is is preferable for the efficient operation of the system that it be included. The conditioned slurry is then fed into a first or rough flotation zone 16.

In each of the flotation zones discussed herein, the feed to the flotation zone from the prior step is separated by froth flotation into (1) an affluent froth enriched in bitumen content that may also contain entrained fine solid particles such as sand referred to herein as "concentrate" and (2) tailings of coarse sand which may contain residual bitumen referred to herein as "tailings". Depending upon the character of the feed and product desired, several zones of flotation may be required. The preferred embodiment described is suitable for processing the typical tar sand deposit found in Utah. The feed to the first flotation zone 16 is the milled and conditioned slurry containing various recycled streams. The feed to the subsequent flotation zones (20,22,24) will be the concentrate produced in the prior zone and may include recycled tailings; except that the tailings from the first flotation zone constitute the feed to the fifth (scavenger) flotation zone 26.

The feed to the first flotation zone 16 will be composed of the milled tar sand grains, bitumen, and the fluid medium. As described in this preferred embodiment, the fluid medium is water plus various dispersing/wetting agents and collectors. As described above, this froth flotation is a method known in the ore processing industry such as described in the Kirk-Othmer "Encyclopedia of Chemical Technology", 3rd Edition, Volume 10 pages 523 through 547, hereby incorporated by reference. Basically, the feed, whether milled slurry, concentrate, or tailing from a prior zone, is fed into the flotation zone agitated, and a gas, normally air, is injected into and dispersed throughout the slurry. The gas bubbles float to the surface to form the affluent (concentrate). In the preferred embodiment, the gas is air. The dispersed bubbles have a selective affinity for the bitumen and collector. As the bubbles rise through the agitated slurry, they collect the bitumen and collector, and float it to the top of the flotation zone in the form of a froth which is removed from the flotation cell and fed to the next step of the process. Sand grains may also be floated into the froth. The sand substantially free of bitumen remains in the slurry where it is removed as tailings. Under the method of the present invention, these tailings may be recycled to prior flotation zones to enhance efficiency.

In the first flotation zone 16, a first concentrate of bitumen and some sand is separated by froth flotation. The first concentrate is removed and fed into a second flotation zone 20. The first tailings from the first flotation zone 16 are comprised of sand which has been wetted with water and contains very little bitumen. The first tailings exit the first flotation zone in line 28. The processing of the first tailings shall be discussed later.

The first concentrate is fed to the second flotation zone 20 and separated by froth flotation in the second flotation zone 20 yielding a second concentrate of bitumen and sand, and a second tailing. The second concentrate flows to the third flotation zone 22 where it is separated to froth flotation into a third concentrate of bitumen and sand, and a third tailing. The third concentrate is fed into the fourth flotation zone 24. In the fourth flotation zone 24, the third concentrate is separated by froth flotation into a fourth concentrate of enriched bitumen tar sands, the desired product, and a fourth tailing.

The fourth concentrate from the fourth flotation cell 24 contains bitumen and sand. The fourth concentrate should contain from above about 90% of the bitumen which was present in the raw tar sand feed and less than about 35% of the sand or solids present in the raw feed. This concentrated tar sand product may then be subjected to known bitumen extraction processes such as the direct coking technique wherein the tar sand is heated and volatile portions of the bitumen are distilled from the sand grains. Residual portions are thermally cracked, resulting in the deposition of a layer of coke around each sand grain. The coke solids are withdrawn from the coker, fluidized with air and transferred to a second vessel where the coke is burned off the sand. Other methods for recovery of the bitumen are solvent extration, or liquid extraction. The aqueous medium is drawn off the bitumen enriched tar sand and may then be recycled to the roughing mill 10, finish mill 14 or conditioner 16 as desired.

It has been determined that recovery may be enhanced by heating the third concentrate prior to injection into the final flotation zone which in the preferred embodiment is the fourth flotation zone 24 by a suitable heat exchanger 30. Heating of the third concentrate in the range of from about 40° to about 50° C. improves selectivity of recovery and results in a high grade bitumen product from the heated flotation zone. Although slight heating of the concentrate enhances the separation of bitumen from the sand grain, heating is not required. The slurry may be heated in any or all of the flotation zones. If the slurry concentrate is heated, it is preferable that heat be applied in the final flotation stage where it can be used more efficiently.

The recovery of bitumen is optimized by recycle of the tailings from each flotation step. The first tailing in line 28 is fed into a scavenger flotation zone or fifth flotation zone 26 and is separated by froth flotation into a fifth concentrate and a fifth tailing. The fifth concentrate may be recycled to either the raw mill 10, finish mill 14, conditioner 18, or first flotation zone 16. It is preferable that it be recycled upstream of first flotation zone 16 to be thoroughly mixed with the entering tar sand slurry. In the preferred embodiment, the fifth concentrate is recycled to the conditioner 18. In the preferred embodiment, the tailings from the second flotation zone 20 are recycled upstream of the first flotation zone 16 preferably to conditioner 18. The third tailings from the third flotation zone 22 are recycled preferably to the second flotation zone 20. The fourth tailings from the fourth flotation zone 24 are recycled preferably to the third flotation zone 22.

The fifth tailings from the fifth flotation zone 26 are mixed with hydrated lime and an organic flocculant such as a polyamide and flow into settling pond 32. In settling pond 32, the hydrated lime generates insoluble calcium phosphates and calcium carbonates, which are precipitated with the sand, leaving a caustic sodium hydroxide solution. The sodium hydroxide solution may be recycled to reuse the water in any of the process steps. Preferably, a portion of the sodium hydroxide solution is recycled upstream of the first flotation zone 16. Recycle of the sodium hydroxide solution to the initial steps such as roughing mill 10 or finish mill 14 decreases the amount of dispersing/wetting agents which must be added because the sodium hydoxide solution serves as a dispersing/wetting agent. The sodium hydroxide solution may also be recycled to one of the later flotation zones such as zone 24. However, such recycle may require the total or partial neutralization of the caustic solution by a suitable acid such as sulfuric acid. This neutralization is necessary to prevent excessive dispersing/wetting agent concentration in the flotation zone.

The presence of excessive dispersing/wetting agent interferes with the froth separation. Excessive dispersing/wetting agent concentration results in the wetting of both the sand and the bitumen, resulting in the decreased flotation of bitumen. The presence of an excessive dispersing/wetting concentration can be observed visually as the bitumen will not rise to the surface of the flotation zone, and can be verified by analysis of the froth for bitumen content. Suitable concentrations of wetting/dispersing agents may be determined experimentally.

In order to achieve this separation on a continuous basis, it is desirable to use a series of zones with each zone having a series of separate cells. These separate cells prevent short circuiting of the zone and preferably six or more cells in each zone are utilized. The flotation zones described above may be of any conventional froth flotation design. Flotation apparatus such as that sold under the trademark "AGITAIR" by the Galigher Company, Salt Lake City, Utah, is suitable for use in the practice of the present invention. Energy requirements are minimized by utilization of gravity flow from flotation zone to flotation zone.

The fourth concentrate from the fourth flotation zone 24 is the bitumen enriched product desired which may be further processed in several manners. The concentrated slurry can be flocculated in a similar manner as the fifth tailings are by the addition of hydrated lime and flocculant. The bitumen concentrate may then be coked as described earlier. An alternative method for processing the bitumen concentrate is to add a light hydrocarbon solvent to the concentrated slurry and recover the bitumen by solvent extraction. The extracted bitumen in the light hydrocarbon solvent may then be treated in a fractionating column to remove the light hydrocarbon solvent for recycle. The aqueous slurry remaining from the light hydrocarbon solvent extraction could be recycled upstream of the first flotation zone. In this manner, any bitumen or solvent remaining in the slurry is removed by froth flotation.

Laboratory testing of raw tar sand ore samples from the Sunnyside deposit in Utah has indicated that the bitumen content of the tar sand ore ranges from about 6.2% to about 11.5% with the typical sample having a bitumen content of about 7.9% to about 8.5% by weight. Laboratory testing of slurries in accordance with the method of the present invention has indicated the preferred approximate ranges of additions per ton of crude tar sand to achieve effective separation as follows:

| Component | Weight (pounds per ton of tar sand feed) |
|---|---|
| Water | 5000–6500 |
| Soda Ash[1] | 8–24 lbs/ton |
| Trisodium Phosphate[2] | 0–8 |
| Light Oil (diesel fuel)[3] | 7–28 |
| Hydrated Lime[4] | 4–12 |
| Organic Flocculant[4] | 0.1–0.2 |

[1]Soda ash may be supplied by crude trona.
[2]Other phosphate compounds can be used. In addition, other dispersing agents such as sodium silicate may be effective but in general they are less effective than the sodium phosphate compounds.
[3]A variety of light oils could be used as effective collectors for the bitumen. Selection of the light oil would be dependent upon availability and cost.
[4]Hydrated lime with flocculant is added to the tailings of the upgraded bitumen to allow for flocculation of the solids so that settling and filtration can be achieved. The addition of the hydrated lime precipitates out calcium carbonate and phosphate and generates a caustic sodium hydroxide which is recycled with the water and aids in the selective wetting in the milling and flotation stages.

When the sodium hydroxide generated by the hydrated lime is recycled, the amount of other dispersing/wetting agents can be reduced to prevent excessive wetting. The following ranges of components per ton of crude tar sand ore should produce effective separation.

| Component | Weight (lbs./ton raw sand feed) |
|---|---|
| Water | 5000–6500 |
| Dispersing/Wetting agents | 8–36 |
| Collectors (diesel fuel) | 7–36 |

Raw tar sand ore containing from about 6.5% to about 9.5% bitumen when processed in accordance with the method of the present invention should result in an upgraded product containing from about 19% to about 36% bitumen on a dry basis. This upgraded product will be produced with very little loss of the bitumen available in the raw tar sand while discarding as tailings over 60% of the sand content of the original feed. Recovery of more than about 90% of the bitumen present in the raw tar sand should be achieved with 95% recovery possible. Additionally, the method of the present invention in achieving these results should consume only approximately 10% of the energy available in the recovered bitumen.

Heating one or more of the flotation zones up to about 50° C. should increase the percentage of bitumen recovery. Also, heating of the stages may allow elimination of one or more of the froth flotation steps.

EXAMPLES

The following examples are presented in order to better facilitate the understanding of the subject invention but are not intended to limit the scope thereof.

Example 1

The effectiveness of the present invention, as well as the improved separation achieved by heating the tar sand slurry, is demonstrated by the test results tabulated below. Comparative batch test results at varying process temperature are recorded in Table 1. The three samples discussed in this example were taken from a composite sample of tar sand obtained from a single drill hole in the Sunnyside, Utah deposit.

All samples of the raw tar ore were crushed to particle size of less than approximately ¼" without the addition of the aqueous medium. In the preferred embodiment, the rough milling of the raw tar sand ore would be accomplished in a slurry as discussed above. Water and the following reagents at the specified concentrations were added to the roughly milled tar sand ore to achieve a 50% by weight solid slurry:

| Reagent | Pound of Reagent Per Ton of Raw Tar Sand Feed |
|---|---|
| Soda Ash | 24 |
| Sodium Hydroxide | 8 |
| Sodium Tri-polyphosphate | 4 |
| Diesel oil | 36 |

The 50% solid slurry was milled 15 minutes in the ball mill to achieve a finish milled slurry in which the particle size was approximately minus 100 microns.

After grinding, the slurry was transferred to a froth flotation machine where the slurry was further diluted by water to achieve a 30 weight percent solids slurry. This 30% slurry was then conditioned in the flotation machine five minutes to thoroughly admix the reagent with the tar sand. The flotation machine here functioned as a conditioner because no air was introduced into the machine, and thus, it was utilized merely as a mixer for the conditioning step. The conditioned slurry was then subjected to froth flotation in the flotation machine by the injection of air into the machine for approximately 15 minutes. The froth from this first flotation step was removed and analyzed for bitumen content. The froth from this first flotation step represents the froth that would be obtained from the first zone and fifth zone as described above in the Detailed Description.

This first concentrate was then returned to the flotation machine, mixed without air for five minutes, and then separated by froth flotation by the injection of air into the flotation machine for eight minutes. The second concentrate of froth was collected. The tailings were removed from the flotation machine and discarded. The concentration from the second flotation step was then returned to the flotation machine and again mixed for five minutes without air, after which it was subjected to froth flotation for a third time by the injection of air for approximately eight minutes. The concentrate from this third flotation was collected and the tailings were removed from the flotation machine.

The concentrate from the third flotation step was once again returned to the flotation machine where it was mixed and then separated by froth flotation to achieve a concentrate from the fourth step, which was the final bitumen enriched product.

In these batch tests, it should be noted that none of the tailings were recycled; thus final recoveries were not, as expected, better than the bitumen recovered in lock cycle tests discussed in the second example.

TABLE 1

| Sample | Process Temp. | Identity of Product Analyzed | Wgt. % of Feed to the Specified Step[1] | % Bitumen Dry Basis Assay of Product[2] | Distribution of Bitumen in Product as % of Total Bitumen in Feed[2] |
|---|---|---|---|---|---|
| A | 5° C. | Raw feed (calculated) | 100.0 | 8.6 | 100.0 |
| | 5° C. | 1st flotation concentrate | 65.6 | 12.5 | 95.3 |
| | 5° C. | 1st flotation tailing | 36.5 | 1.1 | 4.7 |
| | 5° C. | 2nd flotation concentrate | 55.6 | 14.3 | 92.7 |
| | 5° C. | 3rd flotation concentrate | 48.0 | 16.0 | 89.3 |
| | 5° C. | 4th flotation concentrate | 34.4 | 18.2 | 73.0 |
| B | 20° C. | Raw feed (calculated) | 100.0 | 9.5 | 100.0 |
| | 20° C. | 1st flotation concentration | 59.2 | 15.2 | 95.0 |
| | 20° C. | 1st flotation tailing | 43.2 | 1.1 | 5.0 |
| | 20° C. | 2nd flotation concentrate | 46.2 | 18.9 | 91.9 |
| | 20° C. | 3rd flotation concentrate | 41.0 | 21.0 | 90.8 |
| | 20° C. | 4th flotation concentrate | 35.7 | 21.0 | 79.0 |
| C | 40° C. | Raw feed (calculated) | 100.0 | 9.3 | 100.0 |
| | 40° C. | 1st flotation concentrate | 44.9 | 19.9 | 96.3 |
| | 40° C. | 1st flotation tailing | 56.6 | 0.6 | 3.7 |
| | 40° C. | 2nd flotation concentrate | 32.4 | 25.6 | 92.6 |
| | 40° C. | 3rd flotation concentrate | 25.8 | 30.7 | 85.3 |
| | 40° C. | 4th flotation concentrate | 19.3 | 33.5 | 69.6 |

[1]The values in this column illustrate the weight percent of tar sand in the concentrate or tailing based on the weight feed to that step. Thus, the value for the 2nd flotation indicates the percentage of the feed to the second step [i.e., the concentrate from the first step rather than percentage of original feed] that was removed as the 2nd concentrate. Theoretically, the percentages of the 1st flotation concentrate and 1st tailing should equal 100. However, all these values slightly exceed 100 which may be accounted for by the absorption of reagents.

[2]The percent bitumen reported is in two manners. Assay indicates the percentage of bitumen in the indicated product. Thus, the raw feed of Sample A contained 8.6% bitumen with the remainder being sand and other compounds. Distribution indicates the percentage of total bitumen in that stage which is in the bitumen in the feed to first flotation zone was contained in the 1st concentrate and only 4.7% of the bitumen in the feed remained in the tailings.

Table 1 illustrates that froth flotation is a very effective method for increasing the assay concentration of bitumen in the ore. The table also demonstrates that a slight heating of the slurry achieves a more efficient separation by froth flotation producing a higher bitumen assay for the concentrate at each flotation step. As the table indicates, heating of the slurry permits greater recovery of bitumen in each stage as indicated by the decrease in the distribution of the bitumen between flotation stage when the temperature is slightly elevated. Those skilled in the art will appreciate that heating thus contributes to more efficient operation and may allow a reduction in a number of flotations necessary to achieve the desired product.

Example 2

A lock cycle flotation test at room temperature (about 25° C.) was conducted on a drill sample (Sample D) from the Sunnyside, Utah tar sand deposit, this sample being different than the sample utilized in Example 1. The same equipment as used in Example 1 was utilized in this lock cycle test. This test was designed to simulate the preferred embodiment described earlier by recycling the tailings from each flotation step.

The test procedure was as follows. As before, the tar sand sample while dry was crushed to an average size less than approximately ¼ inch. The roughly milled tar sand was then finish milled in a ball mill at 50% solids by combining the raw tar sand ore with reagents in the following amounts and sufficient water to produce 50% solids.

| Reagent | Pounds of Reagent per Ton of Feed |
|---|---|
| Crude Trona Ore | 24 |
| Sodium Hydroxide | 5 |
| Diesel Oil | 18 |

This 50% slurry was then placed in the flotation machine where it was conditioned (mixed) and then separated by froth flotation into a concentrate and tailings. The tailings were removed and the tailing slurry was flocculated by adding hydrated lime and a polyacrylamide flocculant. After flocculation and settling, the clear solution was decanted off for recycle. This solution was then used to simulate recycled water containing sodium hydroxide. In order to prevent excess dispersion/wetting agent by the recycle of sodium hydroxide solution in the final flotation step, it was necessary to add sulfuric acid to adjust the pH of the solution recycled to the final flotation zone to about 7.8. That portion of the sodium hydroxide solution used to simulate recycle to the milling steps did not have to be adjusted because the concentration of dispersing/wetting agent in the first step can be controlled by the adjustment of other dispersing/wetting agents added. As explained earlier, excess dispersing/wetting agents decrease the efficiency and may prevent any separation because the excess dispersing/wetting agents wet not only the solid particles, but also the bitumen and prevent it from rising in the froth. The presence of excess dispersion/wetting agents can be observed visually or by testing the percentage of bitumen recovered in the concentrate and tailing of a zone.

A number of separate cycles were conducted in order to obtain appropriate compositions to simulate a continuous operation. In each cycle, the tar sand was finish milled with the recycled water, and the reagent concentration specified above. In the tailing from the first zone from a previous cycle where mixed with the newly ground slurry and conditioned in the flotation machine for approximately 30 minutes at a slurry, the concentration of which is approximately 38% solids. The resulting mixture was then subjected to a first flotation for five minutes and the tailings were subjected to froth flotation for ten minutes to simulate the fifth flotation zone. The concentrate from the simulated fifth flotation zone was held for recycle to the next test cycle.

The flotation zone was simulated by feeding the concentrate from the simulated first zone and the tailing from the simulated second zone of a previous cycle to the flotation machine for froth separation for seven minutes at about 30% solids. The third flotation zone was simulated by feeding the concentrate of the second simulated zone and the tailing of the fourth simulated zone from a previous cycle to simulate recycle. These were then combined in the flotation machine where the simulated third flotation was conducted for seven minutes at about 25% solids.

The fourth flotation zone was simulated by combining the concentrate from the third simulated zone with recycled caustic water treated with sulfuric acid to achieve a pH of about 7.8 such that the fourth flotation was conducted at about 15% solids. The product from the fourth simulated flotation zone was the final bitumen product.

The treatment of the tailings from the fifth simulated zone required 16 pounds of hydrated lime per ton of feed and 0.015 pounds per ton of feed of a polyacrylamide organic flocculant, such as sold under the trade designation M540 by Stein Hall Products, to obtain effective flocculation and settling. Reducing the basicity of the sodium hydroxide solution for recycle to the simulated fourth flotation zone required 4.4 pounds of sulfuric acid per ton of feed to obtain a pH about 7.8.

The results obtained after the lock cycle test which would simulate a continuous process were as follows:

| Sample | Product | % Weight of Feed | % Bitumen Assay | Bitumen Distribution as % of Total Bitumen Present in the Feed |
|---|---|---|---|---|
| D | Fourth Flotation Zone Concentrate (Bitumen Product) | 32.1 | 25.1 | 94.0 |
| | Fifth Flotation Zone Tailing | 67.9 | 0.75 | 6.0 |
| | Feed (Calculated) | 100.0 | 8.55 | 100.1 |

This lock cycle test which simulated a continuous process allowed approximately 68% of the solid material in the original ore to be removed, and produced a product containing 25% bitumen which represents a recovery of 94% of the total bitumen present in the initial feed.

The bitumen concentrations reported above were determined in accordance with the following procedure. First, the sample was dried and weighed. The weighed portion was then combined with toluene in a reflux condenser until all the bitumen had been removed from the solid particles. The resulting mixture of toluene and bitumen was then placed in a rotoevaporator in which the toluene was stripped from the mixture and condensed into a separate vessel. The percent of bitumen could then be determined from the weight of bitumen recovered.

While the invention has been explained in relation to its preferred embodiment, it is to be understood that various modifications thereof will now be apparent to those skilled in the art upon reading this specification and it is intended to cover such modifications as fall within the scope of the appended claims.

What is claimed is:

1. A froth flotation method suitable for recovery of bitumen from tar sands comprising:

(a) admixing raw tar sand with a fluid medium effective to selectively wet and disperse the sand grains to produce a tar sand slurry;

(b) milling said tar sand slurry to liberate the bitumen from the tar sand grains; and (c) admixing with the tar sand slurry from about 0.35% to about 1.8% by weight of a collector oil based on a unit of raw tar sand feed;

(d) separating the tar sand slurry by ambient froth flotation into a product slurry of bitumen enriched tar sand and a tailing of waste sand slurry substantially free of bitumen; and (e) treating said waste sand slurry with an effective amount of hydrated lime and an organic flocculant to cause flocculation, thereby settling out the suspended sand; and recycling the fluid above the precipitated sand to step (a) or step (b).

2. The method of claim 1 wherein said organic flocculant is a polyacrylamide.

3. The method of claim 1 wherein said medium is an aqueous medium.

4. The method of claim 3 wherein said organic flocculant is a polyacrylamide.

5. The method of claim 1 or 3 wherein said ambient temperature is a temperature up to about 25° C.

6. The method of claim 5 wherein said organic flocculant is a polyacrylamide.

* * * * *